US006035652A

United States Patent [19]

Hashimoto

[11] Patent Number: 6,035,652

[45] Date of Patent: Mar. 14, 2000

[54] IDLE SPEED CONTROL SYSTEM FOR INTERNAL COMBUSTION ENGINE

[75] Inventor: Masahiko Hashimoto, Kanagawa-ken, Japan

[73] Assignee: Nissan Motor Co., Ltd., Yokohama, Japan

[21] Appl. No.: 09/151,400

[22] Filed: Sep. 11, 1998

[30] Foreign Application Priority Data

Sep. 11, 1997 [JP] Japan ..... 9-246406

[51] Int. Cl.[7] ..... F02D 41/08

[52] U.S. Cl. ..... 62/133; 62/323.1; 123/339.17

[58] Field of Search ..... 62/133, 243, 323.4, 62/323.1, 228.1, 228.3; 165/43; 123/339.17, 339.23

[56] References Cited

U.S. PATENT DOCUMENTS

| | | | |
|---|---|---|---|
| 4,976,589 | 12/1990 | Ide | 62/323.4 X |
| 5,249,559 | 10/1993 | Weber et al. | 123/339.17 |
| 5,265,571 | 11/1993 | Sodeno | 123/339 |
| 5,285,649 | 2/1994 | Yamanaka et al. | 62/323.1 X |
| 5,752,387 | 5/1998 | Inagaki et al. | 62/133 |
| 5,806,485 | 9/1998 | DeGeorge | 123/339.17 |

*Primary Examiner*—Harry B. Tanner
*Attorney, Agent, or Firm*—Foley & Lardner

[57] ABSTRACT

An idle speed control system for an internal combustion engine comprises a discharge pressure sensor to detect a discharge pressure of a compressor of an air conditioner, a predicted discharge pressure calculating section to predict a discharge pressure under a condition wherein the air conditioner is steady and ON based on a discharge pressure memorized when the air conditioner was OFF. During a predetermined period after an air conditioner switch turns ON, a control unit calculates a torque correction quantity based on the predicted discharge pressure and after the predetermined period calculates the torque correction quantity based on the actual current detected discharge pressure. Moreover, when the air conditioner switch turns "from ON to OFF" and "from OFF to ON" for a short period, the control unit calculates the torque correction quantity based on a previous actual discharge pressure obtained when the air conditioner switch was ON, instead of on the predicted discharge pressure.

7 Claims, 6 Drawing Sheets

FIG. 3-A
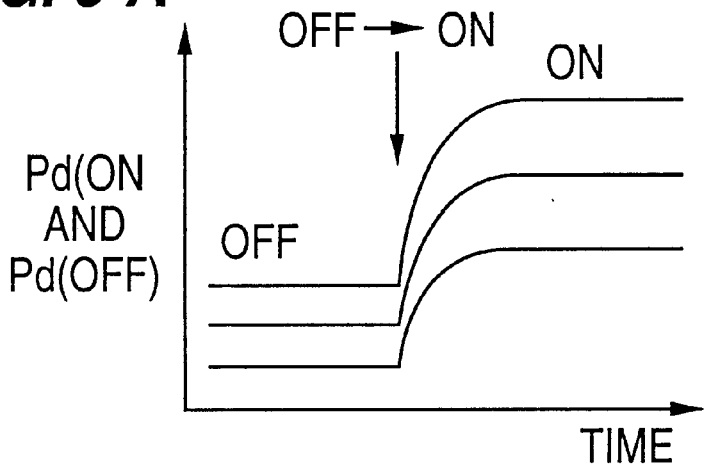
FIG. 3-B
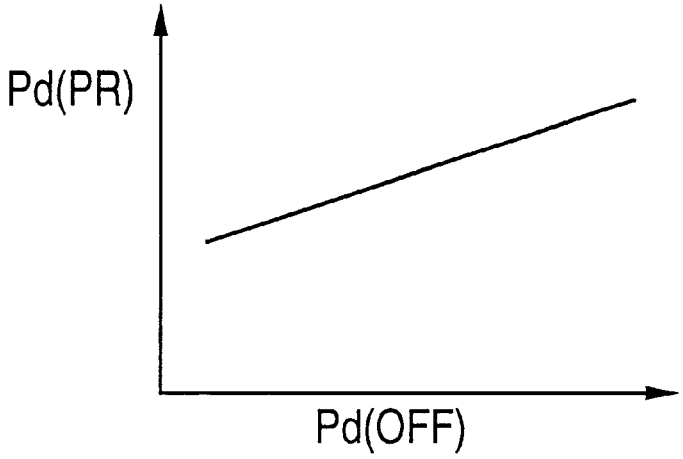
FIG. 3-C
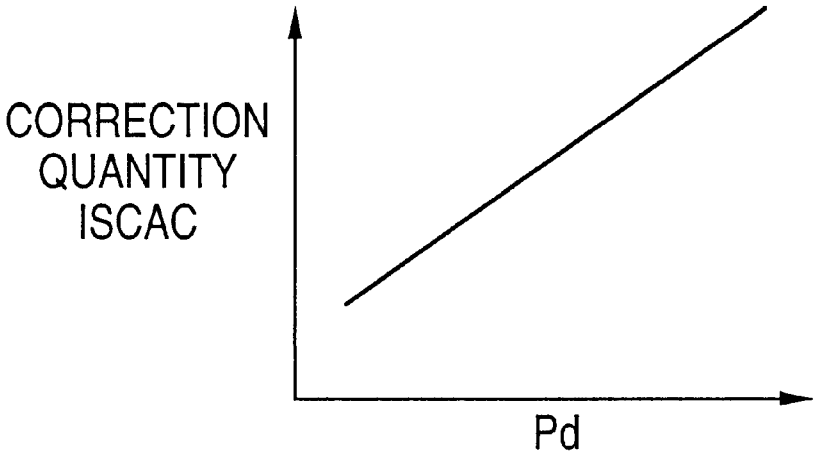

IDLE SPEED CONTROL SYSTEM FOR INTERNAL COMBUSTION ENGINE

BACKGROUND OF THE INVENTION

1. Field of the Invention

The present invention relates to a system for controlling an idle speed of an internal combustion engine in accordance with a change in load due to an air conditioner.

2. Description of the Related Art

Operation of an air conditioner can make the idling operation of an internal combustion engine unstable. In order to prevent the idle speed of the engine from being made unstable by operation of the air conditioner, there is proposed an idle control system which controls the idle air amount so as to ensure a prescribed idle speed in accordance with the load of the air conditioner by regulating the air flow bypassing the throttle valve.

This conventional idle speed control system performs a feedback control to reduce a deviation of a sensed actual idle speed from a desired idle speed which is predetermined as a target. An idle speed control system of this type is shown in Japanese Patent Publications No. Heisei 05-33770 and No. Heisei 05-99046.

In the idle speed control system of such a conventional type, a torque correction quantity based on actual discharge pressure of the compressor of the air conditioner is performed so as to maintain a stable idling condition in spite of the load change of the air conditioner. In this system, the torque correction quantity changes in proportion to actual discharge pressure as actual discharge pressure increases during an air conditioner ON transient.

This conventional system, however, cannot avoid suffering from a temporary decrease of the idle speed due to a delay in response of the engine, even if the torque correction quantity, based on the actual discharge pressure of the compressor, is made quickly.

Therefore during a large change of the load, fluctuation of the idle speed increases and stability of the idle speed becomes worse.

SUMMARY OF THE INVENTION

It is, therefore, an object of the present invention to provide an engine idle speed control system, which can provide stable and responsive idling performance even when a load of the air conditioner changes.

According to the present invention, an idle speed control system for an internal combustion engine comprises:

- a discharge pressure detector to detect a discharge pressure of a compressor of an air conditioner;
- a predicted discharge pressure calculating section to predict a discharge pressure under a condition wherein the air conditioner is steady and ON based on the discharge pressure memorized when an air conditioner ON-OFF detector detected that the air conditioner was OFF;
- a period measuring section to measure a period after the air conditioner ON-OFF detector detects a change from OFF to ON;
- a torque correction quantity calculating section to calculate a torque correction quantity based on the predicted discharge pressure when the period is shorter than a predetermined value, and to calculate a torque correction quantity based on the actual current detected discharge pressure when the period is longer than the predetermined value.

When the air conditioner is switched on during idling, the discharge pressure of the compressor becomes high gradually with a certain delay, and then maintains a stable condition. This discharge pressure of the compressor at the stable condition is influenced by the discharge pressure when the air conditioner was OFF.

Therefore, during a predetermined period after the air conditioner ON-OFF detector detects a change from OFF to ON, the discharge pressure under a condition wherein the air conditioner is steady and ON can be predicted from the discharge pressure when the air conditioner was OFF, and the torque correction quantity within the predetermined period after the ON-OFF detector detects a change from OFF to ON can be calculated with the predicted discharge pressure so as to improve the responsiveness of and stability of idle speed control.

On the other hand, after the predetermined period, the torque correction quantity can be calculated from the actual current detected discharge pressure, since the discharge pressure of the compressor is relatively stable during the period after the predetermined period. This torque correction quantity technique promotes control accuracy because calculations are made with actual pressure obtained from the discharge pressure detector.

Further, when the air conditioner changes from "ON to OFF" and "OFF to ON" over a short period, the torque correction quantity is calculated based on a previous actual discharge pressure obtained when the air conditioner was ON instead of on the predicted discharge pressure so as to promote control accuracy.

BRIEF DESCRIPTION OF THE DRAWINGS

FIG. 3-A illustrates changes in discharge pressure when an air conditioner changes from an OFF condition to an ON condition.

FIG. 3-B illustrates how a predicted discharge pressure changes with discharge pressure of an air conditioner in an OFF condition.

FIG. 3-C illustrates how a correction quantity changes with a discharge pressure of a compressor of an air conditioner.

DETAILED DESCRIPTION OF THE PREFERRED EMBODIMENTS

Figure 1:
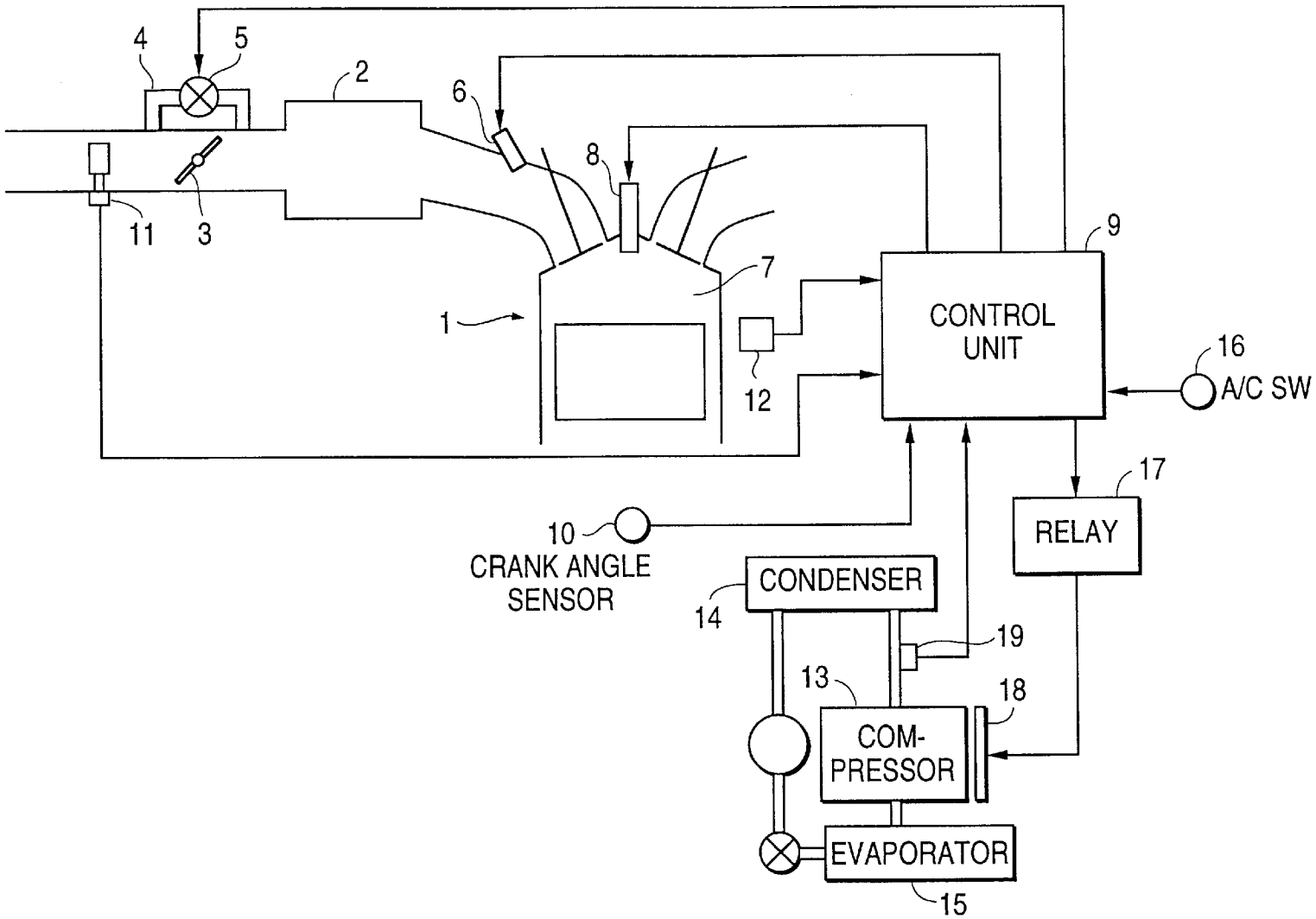
FIG. 1 illustrates a system configuration for a first embodiment of the is present invention.

As shown in FIG. 1, an idle speed control system according to one embodiment of the present invention includes an internal combustion engine 1 of a vehicle, an intake passage 2 for introducing air into the engine 1, a throttle valve 3 disposed in the intake air passage 2, a supplementary air passage 4 bypassing the throttle valve 3, and a supplementary air control valve 5 such as a solenoid valve for controlling an idle air amount. The supplementary air control valve 5 is driven by a duty signal changed ratio of ON-time for a predetermined period and when the duty increases a degree of opening of the supplementary air control valve 5 increases.

Therefore, the duty ratio serves as a torque correction quantity and this arrangement is called a proportional solenoid type arrangement. A step pulse motor can be used instead of the proportional solenoid type system.

A solenoid fuel injector 6 to supply the fuel to each cylinder is provided in the intake air passage 2 and a spark plug 8 to ignite the air-fuel mixture is provided in each combustion cylinder 7.

A control unit 9 to control the supplementary air control valve 5, the fuel injectors 6 and the spark plugs 8 inputs signals from several sensors such as a crank angle sensor 10, an air flow meter 11 and a temperature sensor 12. The crank angle sensor outputs signals at a predetermined crank angle and engine revolution can be calculated with the signals from the crank angle sensor. The air flow meter detects an amount of air flow in the intake air passage 2 and the temperature sensor 12 detects engine coolant temperature.

An air conditioner comprises a compressor 13, a condenser 14, an evaporator 15 and an air conditioner switch 16. Moreover, the air conditioner comprises an air conditioner relay 17 to retard a drive signal to a clutch 18 for a predetermined delay period after the air conditioner switch 16 turns on, and to retard a release signal to the clutch 18 for a predetermined delay period after the air conditioner switch turns off. The air conditioner comprises a pressure sensor 19 to detect a discharge pressure of the compressor 18.

The control unit 9 calculates a final correction quantity ISCON based on a basic correction quantity ISCTW, a feedback correction quantity ISCI, a torque correction quantity ISCAC and a transitional correction quantity ISCACT according to the following equation.

$$ISCON=ISCTW+ISCI+ISCAC+ISCACT$$

The control unit 9 controls the supplementary air control valve 5 by the duty signal in accordance with the final correction quantity ISCON.

The control unit 9 sets the basic correction quantity ISCTW by looking up a table wherein the basic correction quantity is increased as the engine coolant temperature becomes low.

The control unit 9 sets a target idle speed Nset by looking up a table which defines a relationship between the actual engine coolant temperature and the target idle speed Nset. When the control unit 9 compares an actual idle speed with the target idle speed, the feedback correction quantity ISCI is increased by a predetermined integration correction quantity $\Delta I$ if actual idle speed is lower than Nset, and the feedback correction quantity ISCI is decreased by a predetermined integration correction quantity $\Delta I$ if actual idle speed is higher than Nset.

Calculation of ISCTW and ISCI is known. Further details regarding idle speed control are set forth, for example, in U.S. Pat. No. 5,265,571, the entire contents of which are incorporated herein by reference.

Figure 2:
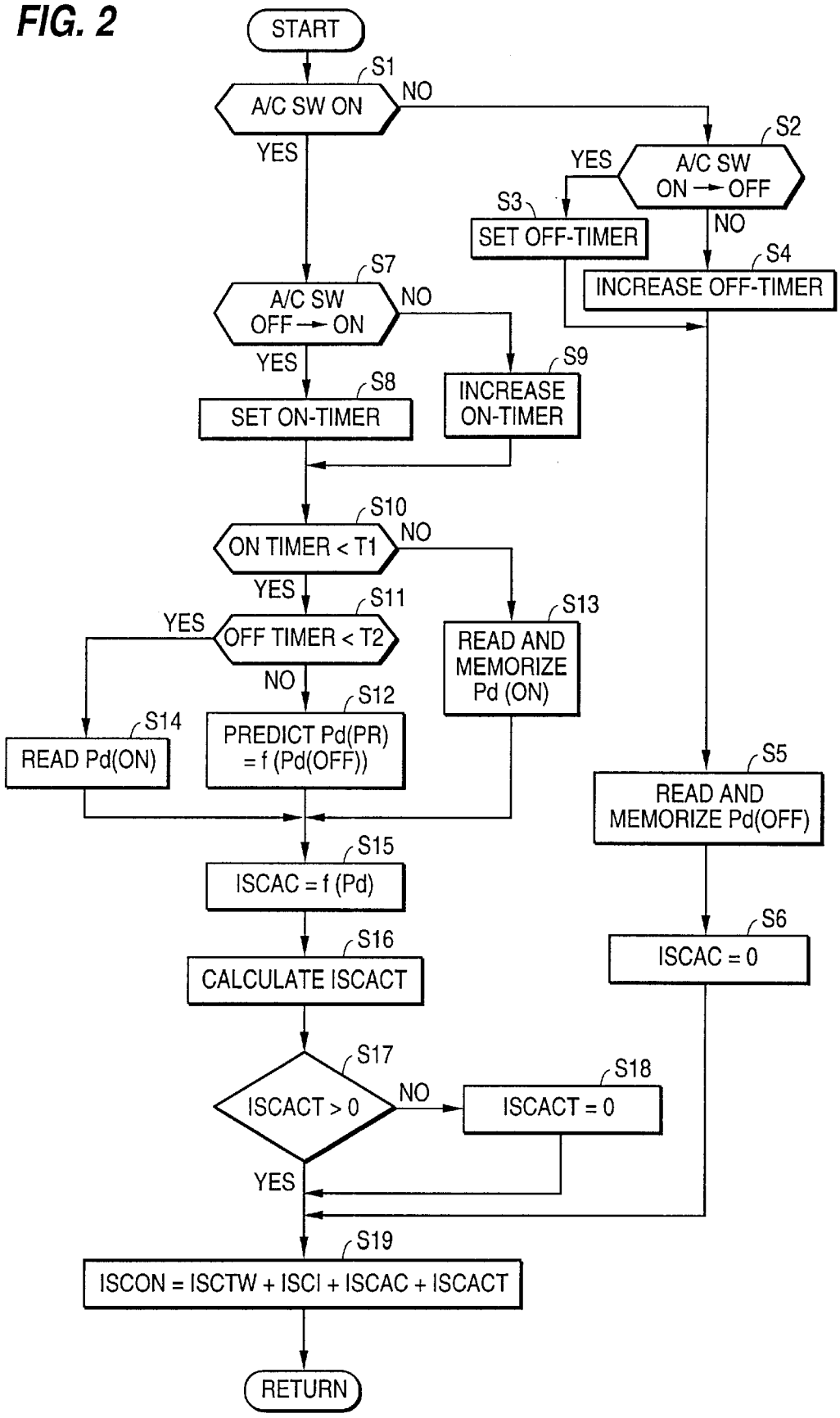
FIG. 2 is a flowchart showing a control procedure employed in the idle speed control system shown in FIG. 1.

The control unit 9 calculates the torque correction quantities ISCAC and ISCACT in accordance with a condition of the air conditioner according to the procedure in the flowchart in FIG. 2. The procedure of FIG. 2 is implemented in hardware, software, or a combination of both, in control unit 9.

A final fuel amount $Ti=Tp\times COEF$ is calculated based on a basic fuel injection amount Tp and several correction amounts COEF in accordance with the final correction quantity ISCON and other correction quantities and the fuel injectors 6 inject the final fuel amount Ti at a predetermined period in synchronism with engine revolution.

The control unit 9 also sets an ignition timing ADV based on the engine revolution N and the basic fuel injection amount Tp and outputs an ignition signal to the spark plug 8.

FIG. 2 shows a control procedure, especially a routine for a torque correction quantity based on an air conditioner load. This routine is performed over a predetermined period.

At a step S1, the control unit 9 determines whether the air conditioner is ON or OFF by checking the signal of the air conditioner switch 16. The control unit 9 proceeds from the step S1 to a step S2 if the air conditioner switch 16 is OFF, and at the step 2, determines whether the air conditioner switch 16 just changed from ON to OFF. The control unit 9 proceeds from the step S2 to a step S3 if the air conditioner switch 16 just changed from ON to OFF and at a step S3 sets an OFF-TIMER, and to a step S4 if air conditioner switch 16 has already changed from ON to OFF and at the step S4 increases the OFF-TIMER. This OFF-TIMER counts an elapsed time after the air conditioner switch 16 changes from ON to OFF.

At a step S5, the control unit 9 reads an actual discharge pressure Pd of the compressor 18 obtained from the pressure sensor 19 and memorizes the discharge pressure Pd as a discharge pressure (OFF). This step serves as a memorizing section to memorize the actual discharge pressure when the air conditioner ON-OFF detector indicates that the air conditioner is OFF. And at this step S5 memorized discharge pressure is replaced by a new one.

At a step S6, the control unit 9 sets the torque correction quantity ISCAC equal to zero (ISCAC=0), and at a step S19 the final correction quantity ISCON is calculated based on the torque correction quantity ISCAC being zero.

On the other hand, the control unit 9 proceeds from the step S1 to a step S7 if the air conditioner switch 16 is ON, and at the step S7, determines whether the air conditioner switch 16 just changed from OFF to ON. The control unit 9 proceeds from the step S7 to the step S8 if the air conditioner switch 16 just changed from OFF to ON and at a step S8 sets an ON-TIMER, and to a step S9 if the air conditioner switch 16 has already changed from OFF to ON, and at the step S9 increases the ON-TIMER. This ON-TIMER counts an elapsed time after the air conditioner switch 16 changes from OFF to ON.

At a step S10, the control unit 9 computes whether the ON-TIMER is shorter than a predetermined period T1. The control unit 9 proceeds from the step S10 to a step S13 if the ON-TIMER is equal to or longer than a predetermined period T1, and at the step S13, reads an actual discharge pressure Pd of the compressor 18 obtained from the pressure sensor 19 and memorizes the discharge pressure Pd as a discharge pressure (ON).

The control unit 9 proceeds from the step S10 to a step S11 if the ON-TIMER is shorter than the predetermined period T1, and at the step S, computes whether the OFF-TIMER is shorter than another predetermined period T2.

The control unit 9 proceeds from the step S11 to a step S14 if the OFF-TIMER is shorter than the predetermined period T2, and at the step S14, reads a discharge pressure Pd memorized at the step S13.

The control unit 9 proceeds from the step S11 to a step S12 if the OFF-TIMER is equal to or longer than the predetermined period T2, and at the step S12, predicts a discharge pressure Pd (PR) under a condition wherein the air conditioner is steady and ON. The predicted discharge pressure Pd (PR) is calculated based on the discharge pressure Pd (OFF) memorized at the step S5 so as to improve the responsiveness and stability of idle speed control. This prediction of discharge pressure is performed by look-up using a map such as FIG. 3-B which defines a relationship between the predicted discharge pressure and a discharge pressure of the air conditioner when the air conditioner was OFF. This step S12 serves as a predicted discharge pressure calculating section to predict a discharge pressure under a condition wherein the air conditioner is steady and ON.

The reason why the discharge pressure can been predicted is, as shown in FIG. 3-A, that the discharge pressure under a condition wherein the air conditioner is steady and ON depends on the discharge pressure under a condition wherein the air conditioner is in an OFF condition.

At step S15, the control unit 9 calculates the torque correction quantity ISCAC based on the predicted discharge pressure Pd (PR) or the discharge pressure Pd (ON) with reference to a map such as in FIG. 3-C. This step S15 serves as a torque correction quantity section.

Figure 4:
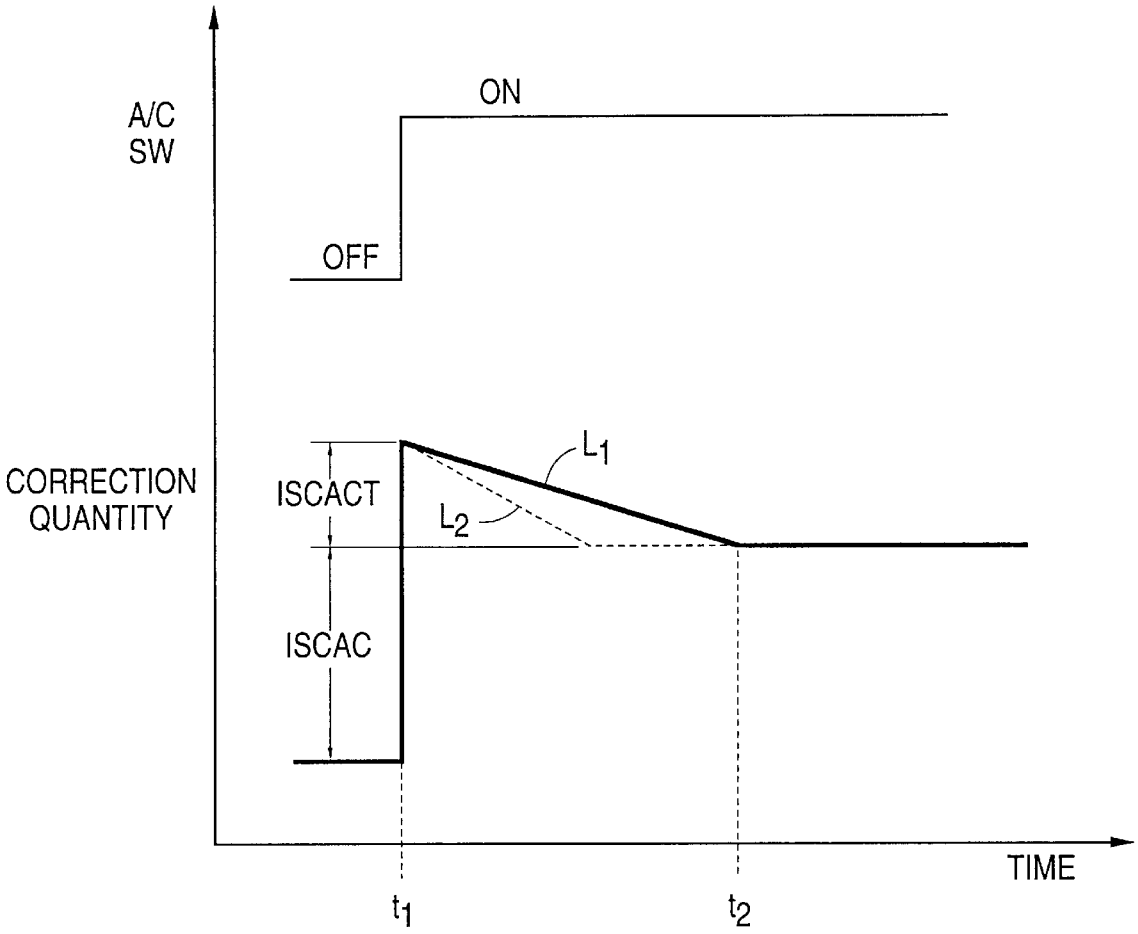
FIG. 4 is a timing chart for correction quantity.

At a step S16, the control unit 9 calculates a transitional torque correction quantity ISCACT so as to prevent the engine speed decreasing at the beginning of the air conditioner being turned on. The control unit 9 sets an initial value of the transitional torque correction quantity ISCACT as a constant value and decreases the transitional torque correction quantity ISCACT by a predetermined amount over time such as shown by line L1 in FIG. 4. The degree of decrease of the transitional torque correction quantity ISCACT can alternatively be set like line L2 in FIG. 4.

At a step S17, the control unit 9 computes whether the transitional correction quantity ISCACT is bigger than zero and proceeds from the step S17 to a step S18 if the transitional correction quantity ISCACT is equal to or smaller than zero, and at the step S18, sets the transitional correction quantity ISCACT to zero. The control unit 9 then proceeds from the step S17 to a step S19.

At the step S19, the control unit 9 calculates the final correction quantity ISCON by the following equation.

$$ISCON=ISCTW+ISCI+ISCAC+ISCACT$$

Figure 5:
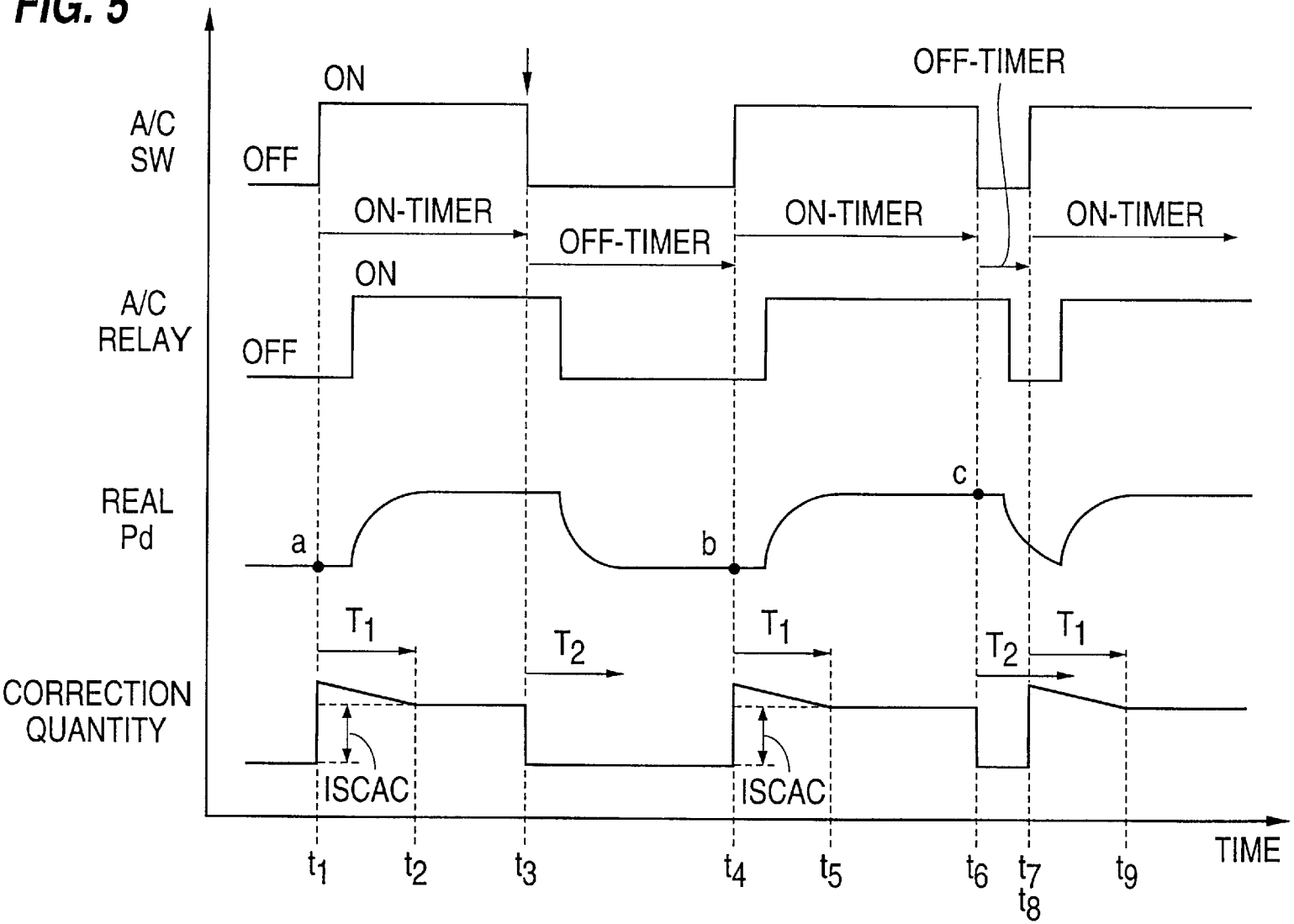
FIG. 5 is a timing chart for the idle speed control of FIG. 2.

FIG. 5 illustrates the timing of the procedure described above.

When the air conditioner switch 16 is turned ON (t1, t4, t7 in FIG. 5), the is ON-TIMER begins to count.

Within the predetermined period T1 (between t1–t2 and t4–t5 in FIG. 5), the control unit 9 predicts the discharge pressure under a condition wherein the air conditioner is steady and ON based on the discharge pressure (as shown by "a" and "b" in FIG. 5) memorized under a condition wherein the air conditioner was OFF. The control unit 9 calculates the torque correction quantity ISCAC based on the predicted discharge pressure and the transitional correction quantity ISCACT. Therefore, the torque correction quantity ISCAC is calculated at a time t1 to improve responsiveness of the engine.

The transitional correction quantity ISCACT is calculated at a time t1 to prevent the engine speed from decreasing at the beginning of the air conditioner being turned ON.

The air conditioner relay 17 is turned on after the predetermined period from when the air conditioner switch 16 has been turned on to adjust the timing of generating torque.

However, the transitional correction quantity ISCACT and the air conditioner relay's delay are not always necessary, and need not be used in certain applications.

After a lapse of the predetermined period T1, the control unit 9 calculates the torque correction quantity ISCAC based on the actual current discharge pressure between t2–t3 and t5–t6 in FIG. 5 in order to promote control accuracy because of being calculated with actual current pressure obtained from pressure sensor 19.

When the air conditioner switch 16 is turned OFF (t3 and t6 in FIG. 5), the OFF-TIMER begins to count.

When the OFF-TIMER count is shorter than the other predetermined period T2 and the ON-TIMER is shorter than the predetermined period T1 (t7–t9 in FIG. 5), the control unit calculates the torque correction quantity ISCAC based on the previous actual discharge pressure as shown by point "c" in FIG. 5.

Under this condition, the predicted discharge pressure obtained in step S12 has a large error because discharge pressure of the compressor is in a transitional condition. Therefore, calculating the torque correction quantity ISCAC based on the previous actual discharge pressure prevents errors that would result if a predicted pressure were used during the transitional condition.

When the ON-TIMER is equal to or longer than the predetermined period T1 (t9 in FIG. 5), the control unit calculates the torque correction quantity ISCAC based on the actual discharge pressure to promote control accuracy because of being calculated with actual pressure obtained from pressure sensor 19.

Figure 6:
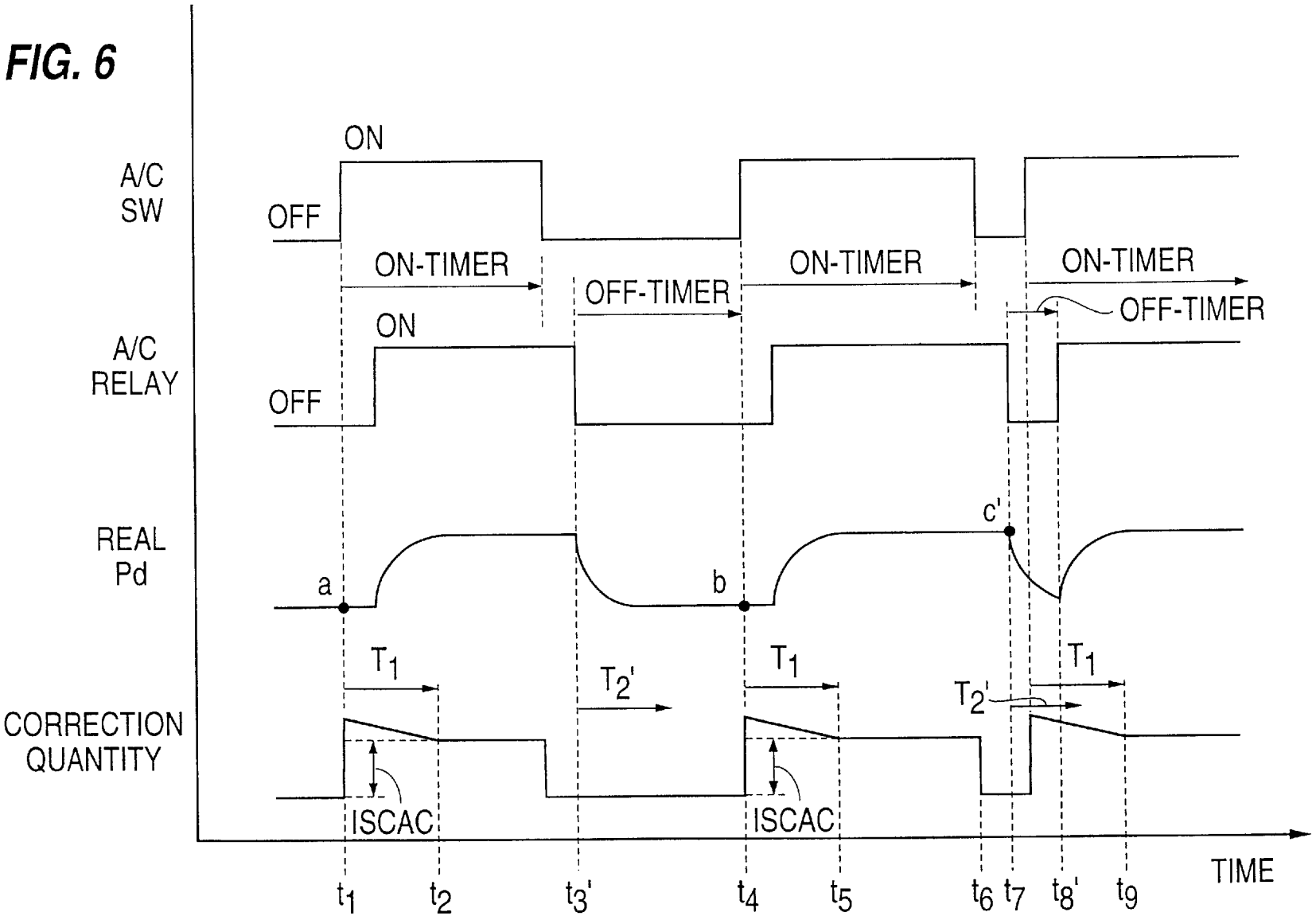
FIG. 6 is a timing chart for another idle speed control system.

FIG. 6 will be used to describe a second embodiment. In this embodiment, the OFF-TIMER begins to count when the air conditioner relay is turned off (t3' and t6' in FIG. 6) instead of when the air conditioner switch is turned off.

When the OFF-TIMER count is shorter than the other predetermined period T2' and the ON-TIMER count is shorter than the predetermined period T1 (t7–t9 in FIG. 6), the control unit calculates the torque correction quantity ISCAC based on the previous discharge pressure as shown by "c" in FIG. 6.

Although the invention has been described above by reference to certain embodiments of the invention, the invention is not limited the embodiments described above. Modifications and variations of the embodiments described above will occur to those skilled in the art, in light of the above teachings. For example, 5 accumulated revolutions of the engine can be used instead of time to measure various periods. The scope of the invention is defined with reference to the following claims.

The entire contents of Japanese Patent Application No. 9-246406, filed Sep. 11, 1997, upon which this application is based, is incorporated herein by reference.

What is claimed is:

1. An idle speed control system for an internal combustion engine, said control system comprising:

a) a discharge pressure detector to detect a discharge pressure of a compressor of an air conditioner;

b) an air conditioner ON-OFF detector to detect ON or OFF condition of said air conditioner;

c) a memorizing section to memorize said discharge pressure when said air conditioner ON-OFF detector detects that said air conditioner is OFF;

d) a period measuring section to measure a period after said air conditioner ON-OFF detector detects a change from OFF to ON;

e) a predicted discharge pressure calculating section to predict a discharge pressure under a condition wherein said air conditioner is steady and ON based on said discharge pressure memorized when said air conditioner ON-OFF detector detected that said air conditioner was OFF;

f) a torque correction quantity calculating section to calculate a torque correction quantity based on the predicted discharge pressure when said period is shorter than a predetermined value and to calculate a torque correction quantity based on actual current detected discharge pressure when said period is longer than said predetermined value; and g) an idle speed controlling device for controlling idle speed based on said torque correction quantity.

2. An idle speed control system as defined in claim 1, wherein said period is time.

3. An idle speed control system as defined in claim 1, wherein said predicted discharge pressure calculating section includes a table defining a relationship between said predicted discharge pressure and said discharge pressure memorized when said air conditioner ON-OFF detector detected that said air conditioner was OFF.

4. An idle speed control system for an internal combustion engine, said control system comprising:

a) a discharge pressure detector to detect a discharge pressure of a compressor of an air conditioner;

b) an air conditioner ON-OFF detector to detect ON or OFF condition of said air conditioner;

c) a memorizing section to memorize a previous discharge pressure obtained when said air conditioner ON-OFF detector detected that said air conditioner was ON;

d) a first period measuring section to measure a first period after said air conditioner ON-OFF detector detects a change from OFF to ON;

e) a second period measuring section to measure a second period after said air conditioner ON-OFF detector detects a change from ON to OFF;

f) a torque correction quantity calculating section to calculate a torque correction quantity based on actual current detected discharge pressure when said first period is longer than a first predetermined value, and to calculate a torque correction quantity based on said previous discharge pressure of the memorizing section when said first period is shorter than the first predetermined value and the second period is shorter than a second predetermined value; and g) an idle speed controlling device for controlling idle speed based on said torque correction quantity.

5. An idle speed control system as defined in claim 4, wherein a change from ON to OFF is detected by an air conditioner switch.

6. An idle speed control system as defined in claim 4, wherein a change from ON to OFF is detected by an air conditioner relay.

7. An idle speed control system as defined in claim 4, wherein said first and second periods are time.

* * * * *